United States Patent [19]

Kanno

[11] Patent Number: 4,898,132

[45] Date of Patent: Feb. 6, 1990

[54] ENGINE STARTING APPARATUS FOR MARINE PROPULSION ENGINE

[75] Inventor: Isao Kanno, Hamamatsu, Japan

[73] Assignee: Sanshin Kogyo Kabushiki Kaisha, Hamamatsu, Japan

[21] Appl. No.: 167,307

[22] Filed: Mar. 11, 1988

[30] Foreign Application Priority Data

Mar. 13, 1987 [JP] Japan ..... 62-57982
Dec. 28, 1987 [JP] Japan ..... 62-333466

[51] Int. Cl.[4] ..... F02N 11/08

[52] U.S. Cl. ..... 123/179 B; 123/179 BG; 123/198 DC; 290/38 R

[58] Field of Search ..... 123/179 A, 179 B, 179 BG, 123/179 K, 198 DC, 630; 290/38 R; 180/287

[56] References Cited

U.S. PATENT DOCUMENTS 4,074,672 2/1978 LaDue et al. ..... 123/198 DC
4,369,745 1/1983 Howard ..... 123/198 DC
4,553,511 11/1985 Hayakawa et al. ..... 123/179 B
4,622,930 11/1986 Hamano et al. ..... 123/179 A

FOREIGN PATENT DOCUMENTS 57-13270 1/1982 Japan ..... 290/38 R

*Primary Examiner*—Andrew M. Dolinar
*Attorney, Agent, or Firm*—Ernest A. Beutler

[57] ABSTRACT

Embodiments of engine starting systems for watercraft wherein a warning is issued in the event the starting system is enabled when a kill switch is closed. In some embodiments the starting system is also disabled if the kill switch is closed.

11 Claims, 1 Drawing Sheet

ENGINE STARTING APPARATUS FOR MARINE PROPULSION ENGINE

BACKGROUND OF THE INVENTION

This invention relates to an engine starting apparatus for a marine propulsion device and more particularly to an improved starting system for a marine engine.

Normally, marine propulsion engines are provided with an electrical control circuit that includes a starting switch for starting of the engine and also a kill switch for emergency or rapid stopping of the engine. Frequently, the kill switch is connected to the operator or an occupant of the watercraft by a cable so that in the event the occupant becomes displaced from the operator's position, the engine will be stopped for emergency purposes. Many times the watercraft, particularly if it is a large one, provides two separate control stations each of which may have starting switches and kill switches.

If, for some reason, a kill switch has been operated and the operator does not notice this when he attempts to next start the watercraft engine, starting will be impossible. If the operator does not realize that the kill switch has be activated, as may readily happen when the kill switch at one station has been actuated and the operator is attempting to restart at another station, continued attempts to start the watercraft can deplete the battery, cause the plugs of the engine to become fouled and starting then will become impossible or very difficult.

It is, therefore, a principal object of this invention to provide an improved starting system for a marine propulsion engine that will overcome these difficulties.

It is a further object of this invention to provide an improved starting system for a marine propulsion device wherein an operator will be warned if the kill switch has been activated when he attempts to start the engine.

SUMMARY OF THE INVENTION

This invention is adapted to be embodied in a starting system for an engine having an operator controlled kill switch for disabling the running of the engine and a starting system for starting of the engine.

In accordance with one feature of the invention, means provide a warning if an attempt is made to start the engine when the kill switch is closed.

In accordance with another feature of the invention, the starter system cannot be energized if the kill switch is closed.

DETAILED DESCRIPTION OF THE PREFERRED EMBODIMENTS

Figure 1:
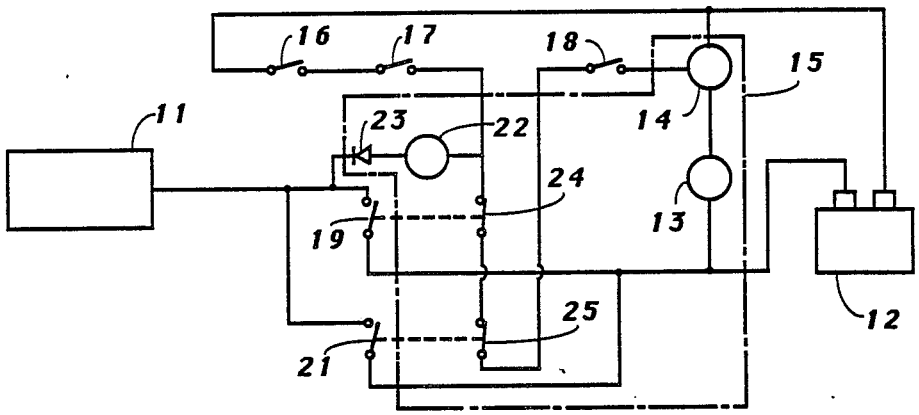
FIG. 1 is an electrical schematic view showing a first embodiment of the invention.

Referring first to the embodiment of FIG. 1, there is depicted a schematic electrical diagram showing a first embodiment of the invention. Only the portion of the wiring diagram relating to the engine starting, running and the warning system is depicted since the other portions of the electrical system are not necessary to understand the construction and operation of the device.

The engine, which is not shown, includes an ignition system 11 which may be of any known type and which is powered by a power supply such as a battery 12. The engine is also provided with a starting motor 13 that is energized from the battery 12 through a starting relay 14. The circuit for the starter is indicated in the dot-dash box 15 and includes a warning system constructed in accordance with this first embodiment of the invention.

The starting relay 14 is energized in a series circuit that includes a main power control switch 16, a starter switch 17 and a neutral switch 18. Of course, the illustrated circuit has been simplified for the purposes of description. When the main power switch 16 is closed, the starter will be energized when the starter switch 17 is closed as long as the transmission of the watercraft or engine has been shifted into neutral as sensed by closing of the neutral switch 18. In this way, the engine cannot be started when the transmission is in gear so as to avoid disturbance of the passengers of the watercraft.

In order to kill the ignition circuit 11 to provide emergency stopping of the watercraft, there are provided first and second kill switches 19 and 21 which are each effective to disable the ignition circuit 11 by grounding it through an appropriate circuit. There are provided two kill switches 19 and 21 that may be located at different locations, for example, one at the deck and one on a flying bridge or the like. The circuit as thus far described may be considered to be conventional and with such a conventional circuit, if one of the kill switches 19 or 21 has been closed, starting will be impossible because even though the starter motor 13 is operated, the ignition system 11 will be disabled.

In accordance with the invention, there is provided a warning device such as a buzzer 22 that will operate to provide a warning signal to the operator if starting is attempted when either kill switch 19 or 21 has been closed. The warning buzzer 22 is in circuit with the grounding circuit in which the kill switches 19 and 21 are incorporated by means of a diode 23. In the main starting circuit, at an appropriate location, there are provided a pair of switch contacts 24 and 25 that are associated with the kill switches 19 and 21, respectively. The construction is such that the switch contacts 24 or 25 will be opened when the kill switches 19 or 21 are closed and thus break the circuit to the starter relay 14.

Conveniently, the kill switches 19 and 21 and contacts 24 and 25 may form part of a double pole, single throw switch. If either of the kill switches 19 or 21 has been closed, its respective contact 24 or 25 will be opened. As a result, if an operator attempts to start the watercraft by closing the starting switch 17, the circuit through the warning buzzer 22 and diode 23 will be energized and the warning buzzer will be sounded to indicate to the operator that the watercraft is being attempted to be started with a kill switch closed. At the same time, the starting circuit for the starter relay 14 will be opened so that battery depletion will be avoided. Rather than a warning buzzer or in addition to it, other types of warning systems may be employed such as indicator light.

Figure 2:
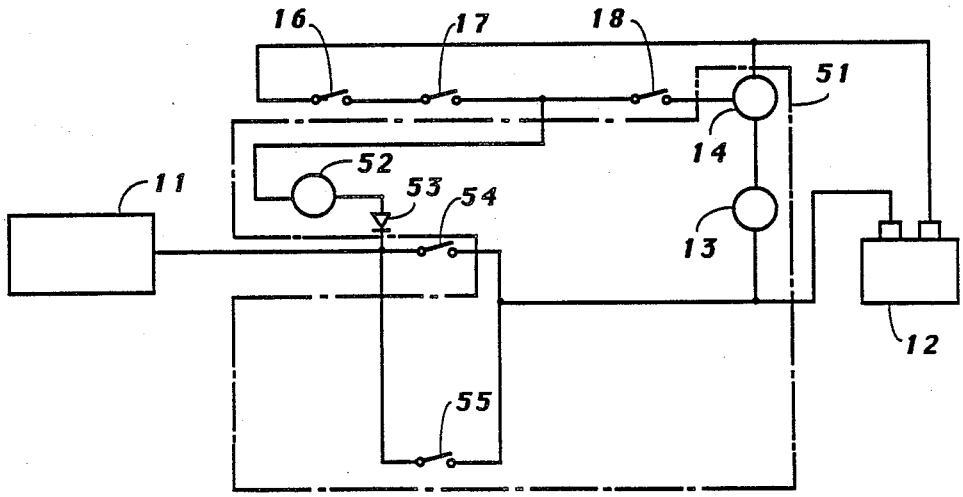
FIG. 2 is an electrical schematic view showing a second embodiment of the invention.

FIG. 2 illustrates another embodiment of the invention which is generally similar to the embodiment of FIG. 1 but which provides a simplification in the circuitry. In this embodiment, however, the circuitry does not preclude the operation of the starting motor when the kill switches are opened.

Referring specifically to FIG. 2, those components which are the same as the components of the embodiment of FIG. 1 have been identified by the same reference numerals. In this embodiment, the starting circuit is identified generally by the reference numeral 51 and includes the main switch 16, starter switch 17, neutral switch 18, starter relay 14 and starter motor 13. In this embodiment, however, a warning buzzer 52 is in circuit through a diode 53 with a pair of kill switches 54 and 55. As with the previously described embodiment, the kill switches 54 and 55 may be located at different locations on the watercraft. In the event either of the kill switches 54 or 55 has been closed, and an attempt is made at starting, the circuit through the warning device 52 will be energized and a warning indication given to the operator. As a result, the safety protection of the previously described embodiment is also present and it is not necessary to use the double pole, single throw switches of the previously described embodiment. However, as has been noted, this embodiment does not prevent the operation of the starter motor 13 under this condition.

In the two embodiments illustrated and described, the warning circuit was in circuit with the starting downstream of the starter switch. It is to be understood that the warning circuit could be in circuit with the main switch only so that upon closure of the main switch, the warning device will be activated to indicate to the operator he should not attempt to start the engine until both of the kill switches have been opened.

It is to be understood that the foregoing description is that of preferred embodiments of the invention and that various changes and modifications may be made without department from the spirit and scope of the invention, as defined by the appended claims.

What is claimed:

1. In a starting system for an engine having an operator controlled kill switch selectively moveable between an opened position for permitting normal running of said engine and a closed position for disabling the running of the engine and a starting system for starting of the engine, means for providing a warning if the starting system is energized when the kill switch is closed.

2. In a starting system for an engine as set forth in claim 1 including an additional kill switch located at different location than the first mentioned kill switch and moveable between opened and closed positions.

3. In a starting system for an engine as set forth in claim 2 wherein the means provide a warning if the starting system is enabled when either of the kill switches is in its closed position.

4. In a starting system for an engine as set forth in claim 1 wherein the means provide a warning if a main power switch is closed to enable the starting system when the kill switch is in its closed position.

5. In a starting system for an engine as set forth in claim 1 wherein the means provides a warning in the event a starter switch is activated when the kill switch is in its closed position.

6. In a starting system for an engine as set forth in claim 1 wherein the means for providing a warning signal also disables the starting circuit.

7. In a starting system for an engine having an operator controlled kill switch selectively moveable between an opened position for permitting normal running of said engine and a closed position for disabling the running of the engine and a starting system for starting of the engine, means for disabling the starting system when the kill switch is in its closed position.

8. In a starting system for an engine as set forth in claim 7 including an additional kill switch located at different location from the first mentioned kill switch and moveable between opened and closed positions.

9. In a starting system for an engine as set forth in claim 8 wherein the means for disabling the starting system is enabled when either of the kill switches is in its closed position.

10. In a starting system for an engine as set forth in claim 7 wherein the means for disabling the starting system operates if a main power switch is closed to enable the starting system when the kill switch is in its closed position.

11. In a starting system for an engine as set forth in claim 7 wherein the means for disabling the starting system operates in the event a starter switch is activated when the kill switch is in its closed position.

* * * * *